US008695208B2

(12) United States Patent
Matz

(10) Patent No.: US 8,695,208 B2
(45) Date of Patent: Apr. 15, 2014

(54) METHOD FOR PRODUCTION OF MONOLITHIC INDUCTIVE COMPONENT

(75) Inventor: Richard Matz, Bruckmuehl (DE)

(73) Assignee: Siemens Aktiengesellschaft, Munich (DE)

( * ) Notice: Subject to any disclaimer, the term of this patent is extended or adjusted under 35 U.S.C. 154(b) by 1007 days.

(21) Appl. No.: 12/602,799

(22) PCT Filed: Jun. 18, 2008

(86) PCT No.: PCT/EP2008/057675
§ 371 (c)(1),
(2), (4) Date: Dec. 3, 2009

(87) PCT Pub. No.: WO2008/155344
PCT Pub. Date: Dec. 24, 2008

(65) Prior Publication Data

US 2010/0171582 A1 Jul. 8, 2010

(30) Foreign Application Priority Data

Jun. 20, 2007 (DE) ..... 10 2007 028 239

(51) Int. Cl.
*H01F 27/30* (2006.01)
*H01F 27/32* (2006.01)

(52) U.S. Cl.
USPC ..... 29/602.1; 29/606; 29/841; 29/851; 336/200

(58) Field of Classification Search
USPC ..... 29/602.1, 606, 604, 841, 851, 852; 336/200, 205
See application file for complete search history.

(56) References Cited

U.S. PATENT DOCUMENTS

| | | | | |
|---|---|---|---|---|
| 5,087,804 | A * | 2/1992 | McGaffigan | 29/602.1 |
| 5,349,743 | A | 9/1994 | Grader et al. | |
| 5,655,287 | A | 8/1997 | Ushiro | |
| 5,802,702 | A * | 9/1998 | Fleming et al. | |
| 5,850,682 | A | 12/1998 | Ushiro | |
| 5,945,902 | A | 8/1999 | Lipkes et al. | |
| 6,045,893 | A | 4/2000 | Fukushima et al. | |
| 7,205,650 | B2 * | 4/2007 | Yoshikawa et al. | 336/200 |
| 2004/0124961 | A1 | 7/2004 | Aoyagi | |
| 2007/0030107 | A1 * | 2/2007 | Waffenschmidt et al. | 336/200 |

FOREIGN PATENT DOCUMENTS

| | | | | |
|---|---|---|---|---|
| DE | 19822782 | A1 | 6/1999 | |
| EP | 0646937 | A1 | 4/1995 | |
| EP | 1367611 | A1 | 12/2003 | |
| JP | 05055044 | A * | 3/1993 | 29/602.1 |
| JP | 06069040 | A * | 3/1994 | 29/602.1 |

OTHER PUBLICATIONS

International Search Report of PCT/EP2008/057675 mailed on Sep. 23, 2008.

* cited by examiner

*Primary Examiner* — A. Dexter Tugbang
(74) *Attorney, Agent, or Firm* — Staas & Halsey LLP

(57) ABSTRACT

A method for manufacturing a monolithic inductive component is provided. The method may include providing a green body comprising a green sheet composite for forming a multilayer ceramic body with an integrated winding and a shaped body of ferritic core material, the green sheet composite being combined with an encapsulation so as to create a cavity with a cavity opening between the encapsulation and the green sheet composite, and the cavity being filled with the ferritic core material through the cavity opening; and heat-treating the green body, a multilayer ceramic body with an integrated winding being created from the green sheet composite and a magnetic core comprising the ferritic core material being created from the green sheet composite.

5 Claims, 2 Drawing Sheets

METHOD FOR PRODUCTION OF MONOLITHIC INDUCTIVE COMPONENT

RELATED APPLICATIONS

The present application is a national stage entry according to 35 U.S.C. §371 of PCT application No.: PCT/EP2008/057675 filed on Jun 18, 2008, which claims priority from German application No.: 10 2007 028 239.9 filed on Jun. 20, 2007.

TECHNICAL FIELD

The invention relates to a monolithic inductive component. It also provides a method for the production of the component and an application of the component.

BACKGROUND

In respect of miniaturization, a multilayer ceramic body offers the advantage that electrical components, for example interconnections, resistors, capacitors and inductors can be integrated in its volume. Known production methods are HTCC (high temperature cofired ceramics) and LTCC (low temperature cofired ceramics) technologies. In these technologies, unsintered ceramic green sheets are provided with through-contacts and planar conduction structures using metal-filled electrically conductive pastes by the stamping and screen printing methods and subsequently sintered together in a stack. This creates heatable, hermetically sealed multilayer planar substrates. These multilayer substrates can function as circuit supports of further components. The advantage of LTCC technology is that the firing temperature for sealing is so low that highly electrically conductive metals which melt at relatively low temperature, such as silver or copper, can be used for integration of the components.

For many fields of application, for example current and voltage transformation or lowpass filters in power electronic circuits, inductive components with better magnetic coupling are required, based on magnetic materials which can amplify and shape the magnetic flux, owing to the lower frequencies (in the MHz range). Many variants of coil and transformer cores made of ferritic ceramic are available for this, which can be fastened afterwards with the aid of metal clips on the aforementioned planar circuit supports.

It has not yet been possible to establish the integration of such inductive components owing to the disparate demands on material and process technology. Above all, two problems are encountered:

According to experience, increasing the magnetic performance of ferrites i.e. increasing the permeability of the core material, with the aid of ceramic technologies, entails a decrease in the resistivity of the core material and therefore a reduction of the important DC isolation between the primary and secondary sides of the transformer.

If current windings are embedded homogeneously in ferrite material, then some magnetic field lines may be closed on shorter paths without contributing to the magnetic coupling of the turns; such stray inductances reduce the performance of the inductive component.

Both difficulties may in principle be resolved by embedding the current-carrying turns in highly insulating material with low permeability. Such a solution is known from U.S. Pat. No. 5,349,743 A. This discloses a method for producing a monolithic multilayer ceramic body with an integrated transformer. LTCC technology is employed, using a low-permeability material with a relatively high electrical resistivity and a higher-permeability material with a relatively low resistivity. These two materials are integrated by stamping out openings in the green sheets of one material, filling the openings with sheet portions or sheet stacks of the other material, and subsequently sintering them together. This process, which inherently involves lateral structuring of green sheets, is elaborate and relatively expensive.

SUMMARY

It is therefore an object of the invention to provide a way in which an inductive component can be integrated in a multilayer ceramic body.

To achieve the object, a monolithic inductive component is provided including at least one multilayer ceramic body with an integrated winding and at least one magnetic core including ferritic core material, the magnetic core being formed by a shaped part.

To achieve the object, a method is also provided for the production of the monolithic component, including the following method steps: a) providing a green body including a green sheet composite for forming a multilayer ceramic body with the integrated winding and a shaped body including the ferritic core material, b) heat-treating the green body, a multilayer ceramic body with an integrated winding being created from the green sheet composite and a magnetic core including the ferritic core material being created from the green sheet composite.

The green body is a green sheet composite. The shaped body is a green body with a freely shaped ferritic core material. The green sheet composite and the shaped body together form a (complete) green body which is sent to a cofiring process.

The shaped body including the ferritic ceramic material may be a pre-compacted ferritic core. In particular, however, the shaped body itself is a green body. This means that compaction of the ferritic ceramic material takes place during the heat treatment. The term green body is generally intended to mean a ceramic body including an as yet uncompacted ceramic material. The green body may include organic additives such as binders and dispersants. The green body may however also consist of a molding of the ferritic core material or precursors of the ferritic core material. The ferritic ceramic material is formed from the precursors during the heat treatment. The green sheet composite and the shaped body are combined to form the monolithic, i.e. one-piece inductive component in a common heat treatment step (cofiring).

With regard to the problems described in the introduction, it is particularly advantageous to electrically insulate the winding in the multilayer ceramic body. According to a particular configuration, the multilayer ceramic body therefore includes dielectric ceramic material.

In order to form an efficient inductive component, the sheet composite may include openings into which the shaped part projects. For example, such an opening is enclosed by a winding introduced in the sheet composite with the aid of an electrically conductive paste.

The shaped part may be in one piece. Preferably, the shaped part is in two or more pieces. It consists of at least two parts. Efficient control of the magnetic flux can therefore be achieved with the aid of the core. For instance, the emerging stray inductances can be influenced by producing an air gap between the parts of the core. The air gap may be formed by a thin ceramic layer of the multilayer ceramic body with a low permittivity. To this end, for example, the above-described opening of the sheet composite is configured as a blind hole which is filled by paste or powder processing with segments of the ferritic shaped part.

In the method, the functions of the magnetic permeability and the electrical insulation in their respective spatial regions of the component are respectively fulfilled by specific tailor-made ceramics, which results in a high effectiveness of the design and the requirement and use of the component. If need be, different dielectric and ferritic ceramic materials may be used. If the inductive component is intended to be used at high frequencies, for example in the range of between 1 and 2 GHz, then hexaferrite ceramics may preferably be used, in particular barium hexaferrite ceramics. These have a permeability of between about 10 and 30.

A second class of ceramics may be used when frequencies in the medium range of about 10 to about 30 MHz are required. In this case, for example, CuNiZn ferrite materials may be used. The permeability of ferritic ceramics, which are employed for components to be used in this medium frequency range, has permeability values from about 150 to about 500.

Another class of ceramics is furthermore available, which are used for components in the relatively low frequency range of between about 1 and about 3 MHz. In this case, for example, MnZn ferrite materials may be used. Ceramics which are used in this class preferably have permeability values of between about 500 and 1000.

The invention may also be implemented in HTCC technology. It is, however, particularly advantageous to select the ceramic materials so that compaction takes place at a relatively low temperature and the LTCC technology can therefore be used. In a particular configuration, green sheets and/or a ferritic ceramic material are therefore used with glass. A proportion of glass in a green sheet or in the ferritic ceramic material ensures compaction at lower temperatures. The sintering process creates a glass ceramic having a ceramic phase and a glass phase. The ferritic ceramic material and/or the dielectric ceramic material include glass.

The shaped part may be prefabricated. This means that the shaped part is fabricated before being combined with the green sheet composite. The shaped part is produced when combining with the green sheet composite. In order to provide the green body in a particular configuration, the green sheet composite is therefore combined with an encapsulation so as to create a cavity with a cavity opening between the encapsulation and the green sheet composite, and the cavity is filled with the still shapeable ferritic core material through the cavity opening. The cavity is filled, for example, with an oxidic starting material in the form of a bulk material. It is however also conceivable to fill the cavity with a slurry, which contains the ferritic core material or the starting material of the core material.

According to a particular configuration, the shaped body comprises a ferritic slurry or a flowable ferritic green powder. The shaped body is dried and/or compacted under pressure/temperature before removing the encapsulation.

The encapsulation is preferably elastically deformable. This means that pressure can be exerted externally onto the e.g. powdered ferritic core material with which the cavity is filled, so as to create a stable self-supporting ferrite mold. To this end, an encapsulation made of silicone is preferably used. Other elastically deformable encapsulation materials may likewise be envisaged.

The encapsulation may remain in the composite including the shaped part and the green sheet composite for the heat treatment. To this end, the encapsulation preferably consists of an organic material which becomes oxidized during the heat treatment and is removed via the gas phase. It is however also conceivable, in particular, for the encapsulation to be removed after forming the shaped part and therefore the heat treatment. To this end, the encapsulation may have an anti-adhesion film in the cavity, which makes it easier to separate the shaped part and the encapsulation.

It is particularly advantageous that the method can be carried out on a board. A multiplicity of components may be produced in parallel.

The configuration of the inductive component is arbitrary. Preferably, the inductive component includes at least one coil and/or at least one transformer.

The component may be used in power electronics, for example for current or voltage transformation or as a lowpass filter. For example, the component is a circuit element of an electronic ballast device (EBD) for a discharge lamp.

In summary, the invention offers the following particular advantages:

- By a fully ceramic design, the component achieves high temperature compatibility. It is therefore suitable for installation in the vicinity of the heat sources, for example lamps and motors.
- Low-sintering ferrite material, for example special MnZn ferrite, allows economical manufacture on a board in a single sintering process together with the multilayer ceramic body (circuit board).
- Temperature differences for the circuit board are reduced by monolithic integration of the ferrite.
- Deliberate use of the ferrite only on the inductive component achieves economical integratability with other circuit components. There are no surface-wide ferrites, as required by simple continuous sheet technology.
- The ferrite volume can be minimized by the invention. Owing to the minimized ferrite volume, thermal stresses between the various materials are minimized. This leads to high stability and reliable process management.
- The ferrite shaped parts may be produced separately or directly on the multilayer body in the hollow molds by pressing green powder, injection molding or similar methods. It is therefore not necessary to handle small sheet portions.
- The overall height of the ferrite core is subject to less restrictions than when constructed from ceramic green sheets, so that a constant magnetic cross section of sufficient size is achieved along the entire magnetic path length and overloading of the ferrite core is avoided.
- The functions of the magnetic permeability and the electrical insulation in their respective spatial regions of the component are respectively fulfilled by specific tailor-made ceramics, which results in a high effectiveness of the design and high performance of the component.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawing, in which.

DETAILED DESCRIPTION The following detailed description refers to the accompanying drawings that show, by way of illustration, specific details and embodiments in which the invention may be practiced.

A monolithic multilayer ceramic body with an integrated inductive component is produced with the aid of LTCC technology. The inductive component is a transformer. The green ceramic sheets used include proportions of glass, so that they can be sintered at a relatively low temperature (below 900° C.)

The unsintered ferrite compound is subsequently joined to the green sheet composite for common sintering (cofiring).

Figure 1:
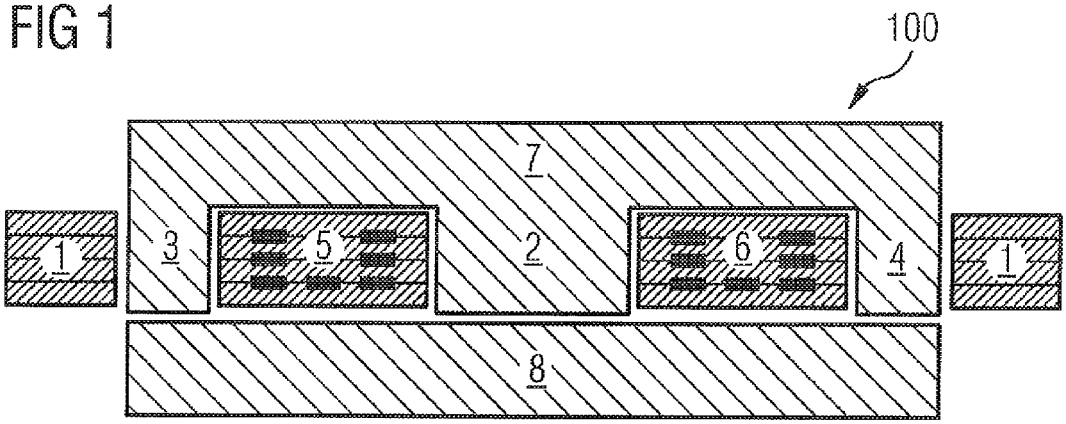
FIGS. 1 and 2 respectively show a monolithic inductive component in a lateral cross section.
Figure 2:
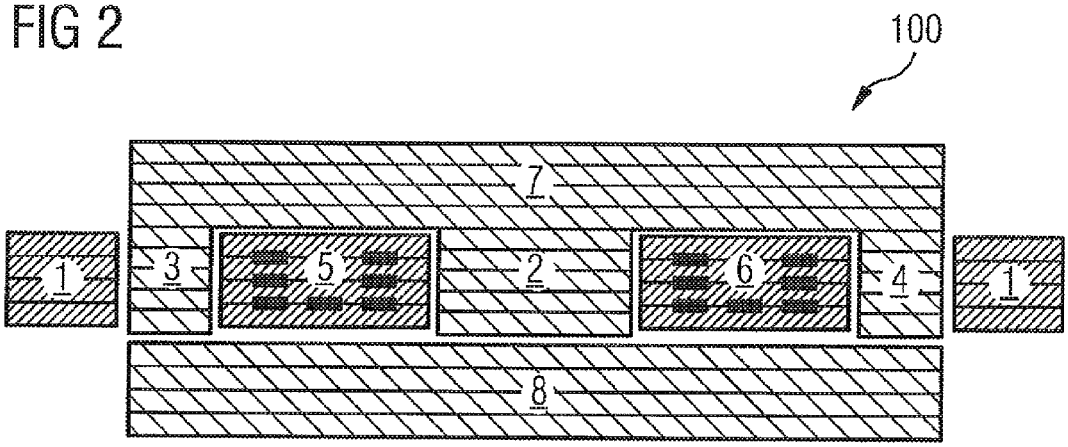
Figure 3:
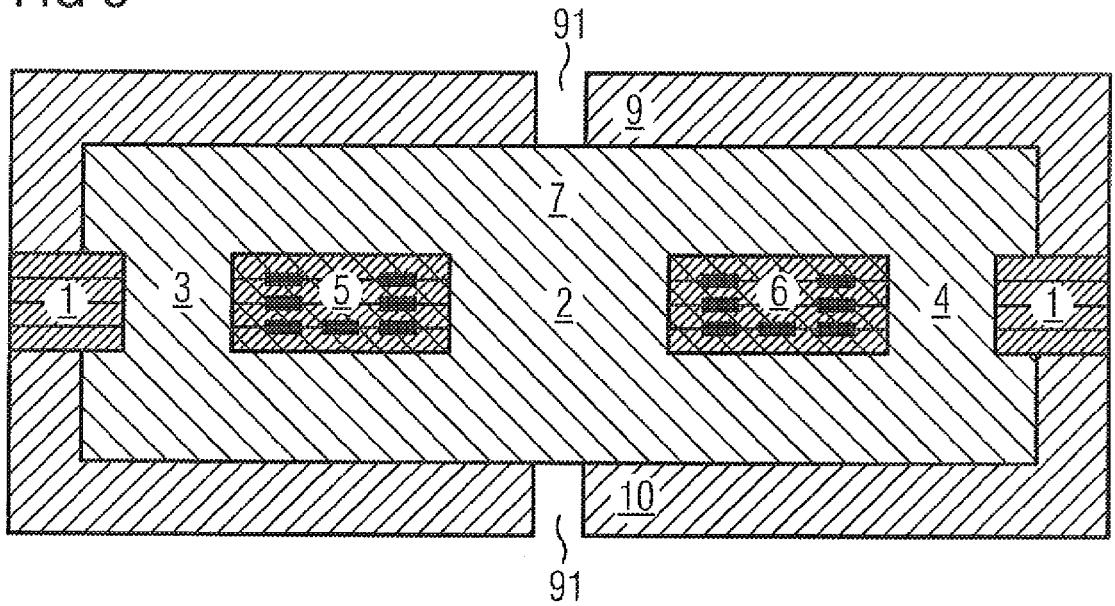
FIG. 3 depicts a method for producing a monolithic inductive component.

FIGS. 1 to 3 respectively show a planar transformer or a planar coil in a section perpendicular to the circuit support with corresponding functional materials and component parts.

The component consists of a multilayer ceramic body (multilayer circuit board) 1 with openings 2, 3 and 4. Closed current-carrying turns are embedded between the layers in the regions 5 and 6 of the multilayer body. The effect achieved by a suitable layer is, for example, that all the currents flow into the plane of the drawing in the region 5 and out of it in the region 6, so that a high magnetic flux density is created in the opening 2 by superposition of the contributions.

The transformer is formed by two coils, which do not have an electrically conductive connection between them but are coupled together by the magnetic field (inductively).

The core including the ferritic material consists of two parts and 8 (FIGS. 1 and 2). According to an alternative embodiment, the core is in one piece. The core consists only of a single part 7 (FIG. 3). The limbs of the core are arranged in the openings 2, 3 and 4 of the multilayer ceramic body in both exemplary embodiments.

Various shaping methods are used in order to produce the shaped part including the ferritic ceramic material.

For example, the ferritic core may be constructed from individual layers and then mechanically processed (FIG. 2). An alternative to this employs casting of a ceramic slurry or plastic deformation of an accurately dimensioned ferrite compound. This may for example also be carried out directly on the circuit support, as represented in FIG. 3. To this end, the green sheet composite is combined with an encapsulation 9, which has an encapsulation opening 91. Ferrite compound is introduced as slurry or powder through the encapsulation opening. After drying or pressure/heat treatment, the encapsulation may be removed for subsequent reuse. The sintering is then carried out, so as to form the multilayer ceramic body and the ferrite core.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come wwithin the meaning and range of equivalency of the claims are therefor intended to be embraced.

The invention claimed is:

1. A method for manufacturing a monolithic inductive component, comprising the following method steps:

providing a green body comprising a green sheet composite for forming a multilayer ceramic body with an integrated winding and a shaped body of ferritic core material, the green sheet composite being combined with an encapsulation so as to create a cavity surrounded by the encapsulation except for at least one cavity opening, by filling the cavity with a ferritic slurry or a flowable ferritic green powder through the at least one cavity opening, forming the shaped body by at least one of drying and compacting the shaped body under at least one of pressure and temperature, and removing the encapsulation after the shaped body is formed; and heat-treating the green body, the multilayer ceramic body with the integrated winding being created from the green sheet composite and a magnetic core comprising the ferritic core material being created from the green sheet composite.

2. The method as claimed in claim 1, wherein the encapsulation is removed before the heat treatment.

3. The method as claimed in claim 2, wherein the encapsulation is provided with an anti-adhesion film in the cavity.

4. The method as claimed in claim 2, wherein a multiplicity of inductive monolithic components are produced on a board.

5. The method as claimed in claim 1, wherein an encapsulation made of silicone is used.

* * * * *